US007272999B2

(12) United States Patent
Cutler et al.

(10) Patent No.: US 7,272,999 B2
(45) Date of Patent: Sep. 25, 2007

(54) T-HANDLED TORQUE-LIMITING DRIVER

(75) Inventors: Brian Cutler, Rowland Heights, CA (US); Charles P. Davis, Torrance, CA (US); Jay J. Kurtovic, deceased, late of Walnut, CA (US); by Tony Zlatko Kurtovic, legal representative, Walnut, CA (US)

(73) Assignee: Snap-on Incorporated, Kenosha, WI (US)

( * ) Notice: Subject to any disclaimer, the term of this patent is extended or adjusted under 35 U.S.C. 154(b) by 47 days.

(21) Appl. No.: 11/056,702

(22) Filed: Feb. 11, 2005

(65) Prior Publication Data

US 2006/0179981 A1 Aug. 17, 2006

Related U.S. Application Data

(60) Provisional application No. 60/543,835, filed on Feb. 11, 2004.

(51) Int. Cl.
*B25B 23/143* (2006.01)

(52) U.S. Cl. ..... 81/475; 81/467

(58) Field of Classification Search ..... 81/467, 81/473–476, 58.3

See application file for complete search history.

(56) References Cited

U.S. PATENT DOCUMENTS 2,536,225 A * 1/1951 Rice ..... 81/475
2,732,746 A 1/1956 Livermont
2,797,564 A 7/1957 Bonneau et al.
2,820,381 A 1/1958 White
2,826,107 A 3/1958 Woods
2,984,133 A 5/1961 Livermont
3,001,430 A 9/1961 Cranford
3,651,718 A 3/1972 Thomasian
3,890,859 A 6/1975 Grabovac et al.
3,958,469 A 5/1976 Meese
4,063,474 A 12/1977 Klopping
4,207,783 A 6/1980 Grabovac
4,238,978 A 12/1980 Leone
4,517,865 A 5/1985 Huang
5,239,875 A 8/1993 Stasiek et al.
5,546,816 A 8/1996 Jansson et al.
5,746,298 A 5/1998 Krivec et al.
6,095,020 A 8/2000 Rinner
6,131,489 A * 10/2000 Yang ..... 81/58.3
6,155,147 A 12/2000 Dzieman et al.
6,640,674 B1 11/2003 Rinner et al.

* cited by examiner

*Primary Examiner*—Joseph J. Hail, III
(74) *Attorney, Agent, or Firm*—Seyfarth Shaw LLP

(57) ABSTRACT

A torque-limiting driver includes a housing, a shaft carried by the housing for rotation relative thereto and having a workpiece-engaging tip projecting from the housing, a torque-limiting mechanism coupled between the housing and the shaft and responsive to rotation of the housing in a predetermined direction to rotate the shaft at torques below a predetermined torque and accommodating rotation of the housing relative to the shaft at said predetermined torque and above, a torque-determining structure disposed in the housing and movable relative to the torque-limiting mechanism for adjusting the predetermined torque, and the housing including a stop portion engageable with the torque-determining structure for preventing torque-adjusting movement thereof.

13 Claims, 4 Drawing Sheets

T-HANDLED TORQUE-LIMITING DRIVER

CROSS-REFERENCE TO RELATED APPLICATION

This application claims the benefit of the filing date of U.S. provisional application No. 60/543,835, filed Feb. 11, 2004.

BACKGROUND

This application relates to driving tools of the type used for driving fasteners or the like and, in particular, relates to rotational tools of the torque-limiting type.

Various types of driving tools, such as screwdrivers, nut drivers, wrenches and the like are known, as are torque-limiting tools, such as torque wrenches and torque-limiting screwdrivers. The latter types of tools are typically rather complex and expensive and are designed to be long-lasting and/or heavy-duty, particularly tools designed for use in commercial and industrial applications. Furthermore, driving tools, such as screwdrivers, nut drivers and the like, are commonly designed to have removable or replaceable bits for driving different sizes of fasteners, and this replaceability feature may complicate the design of the tool and add to the expense thereof.

However, there are various applications wherein tools need not survive heavy-duty, long-lasting use. For example, tools may be designed for specific uses, such as for sporting goods, furniture assembly, field assembly of products and certain military applications wherein the tool may be either relatively infrequently used or need only be used once or twice and, accordingly, may need only a single bit or workpiece-engaging member. For such applications it is desirable to have a tool which is low-cost and may be suitable for mass production and, if need be, could even be disposable, without sacrificing ergonomic features.

SUMMARY

This application discloses a driving tool which avoids disadvantages of prior drivers while having additional structural and operational advantages.

There is disclosed a driver which is of relatively simple and economical construction.

In particular, there is disclosed a low-cost, torque-limiting driving tool which is ergonomically designed.

In an embodiment, there is provided a torque-limiting driver includes a housing, a shaft carried by the housing for rotation relative thereto and having a workpiece-engaging tip projecting from the housing, a torque-limiting mechanism coupled between the housing and the shaft and responsive to rotation of the housing in a predetermined direction to rotate the shaft at torques below a predetermined torque and accommodating rotation of the housing relative to the shaft at said predetermined torque and above, a torque-determining structure disposed in the housing and movable relative to the torque-limiting mechanism for adjusting the predetermined torque, and the housing including a stop portion engageable with the torque-determining structure for preventing torque-adjusting movement thereof.

There may also be provided, in an embodiment, a method for indicating that a predetermined torque has been reached, including providing a torque-limiting mechanism responsive to rotation of a housing in a predetermined direction to rotate a shaft at torques below a predetermined torque and accommodating rotation of the housing relative to the shaft at said predetermined torque and above, moving a torque-determining structure for selectively adjusting the predetermined torque, and locking the torque-determining structure against movement to prevent unintentional change of the predetermined torque.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 19:
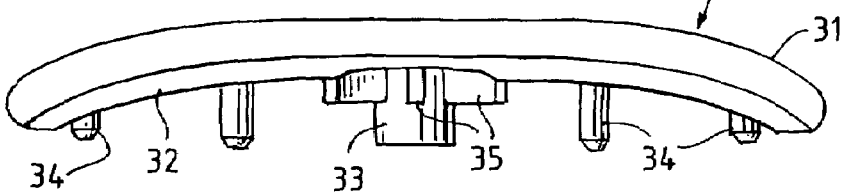
FIG. 19 is an enlarged, side elevational view of the cap of the driver of FIG. 1.

Referring to FIGS. 1-8, there is illustrated a torque-limiting driver, generally designated by the numeral 20 having a generally T-shaped housing 21, which includes a generally T-shaped base member 22 having a hollow, generally cylindrical stem portion 23 with a tapered end 24 closed by a circular end wall 25 having a circular bore 26 formed axially therethrough. The upper end of the stem portion 23 is integral with a pair of laterally outwardly projecting and diametrically opposed arms 27, each being provided with one or more cylindrical upstanding sockets 28 and with open-top receptacle slots 28*a*. The inner surface of the tapered end 24 of the stem portion 23 is provided with a plurality of equiangularly spaced-apart and longitudinally extending keyways 29 (see FIG. 5), which may be six in number. Referring also to FIG. 19, the upper end of the base member 22 is closed by an elongated, generally oval-shaped cap 30 having a top wall 31 integral around its periphery with a depending skirt 32 sized and shaped to mateably engage the upper peripheral edge of the base member 22 around the periphery of the arms 27 and the upper end of the stem portion 23. Depending from the top wall 31 centrally thereof is a cylindrical, hollow neck 33. Also depending from the top wall 31 are stakes 34 adapted to be mateably received in the sockets 28. Plural blades 35 may extend radially outwardly from the neck 33 and may be six in number. The outer surface of the cap 30 may be provided with an overmolded grip 36 which may be formed of a suitable elastomeric material.

Figure 7:
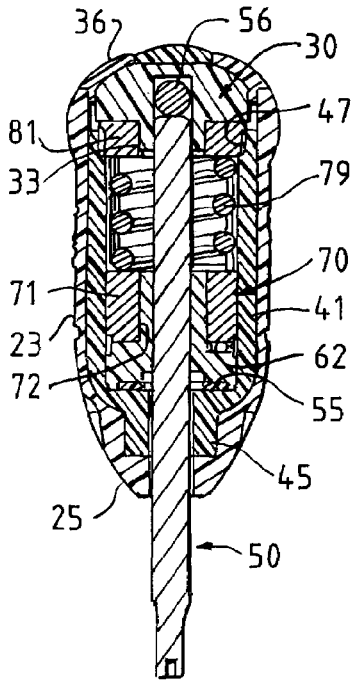
FIG. 7 is a sectional view taken generally along the line 7-7 in FIG. 1.

Referring in particular to FIGS. 5 and 7-10, the driver 20 includes a sleeve 40 having an elongated, hollow, generally cylindrical body 41, integral at one end with a pair of diametrically opposed and radially outwardly extending flanges 42. Formed along the inner surface of the cylindrical body 41 at circumferentially spaced-apart locations are a plurality of longitudinally extending keyways 43 (see FIGS. 5 and 10), which may be six in number. The cylindrical body 41 has a tapered end 44 closed by a circular end wall 45 having an axial bore 46 formed therethrough. The cylindrical body 41 is provided adjacent to the open end thereof with internal threads 47 (FIG. 7). Formed on the outer surface of the tapered end 44 are longitudinally extending and radially outwardly projecting keys 49 (FIGS. 8 and 9), which may be six in number. In assembly, the sleeve 40 is coaxially received in the stem portion 23 of the driver base member 22 to the position illustrated in FIGS. 5 and 7, with the end wall 45 seated on the end wall 25, the keys 49 being respectively received in the keyways 29 and the flanges 42 respectively received in the receptacle slots 28*a* for retaining the sleeve 40 against rotation relative to the driver base member 22.

Figure 3:
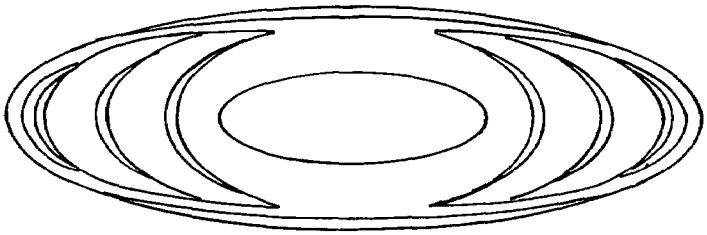
FIG. 3 is a top plan view of the driver of FIG. 1.
Figure 1:
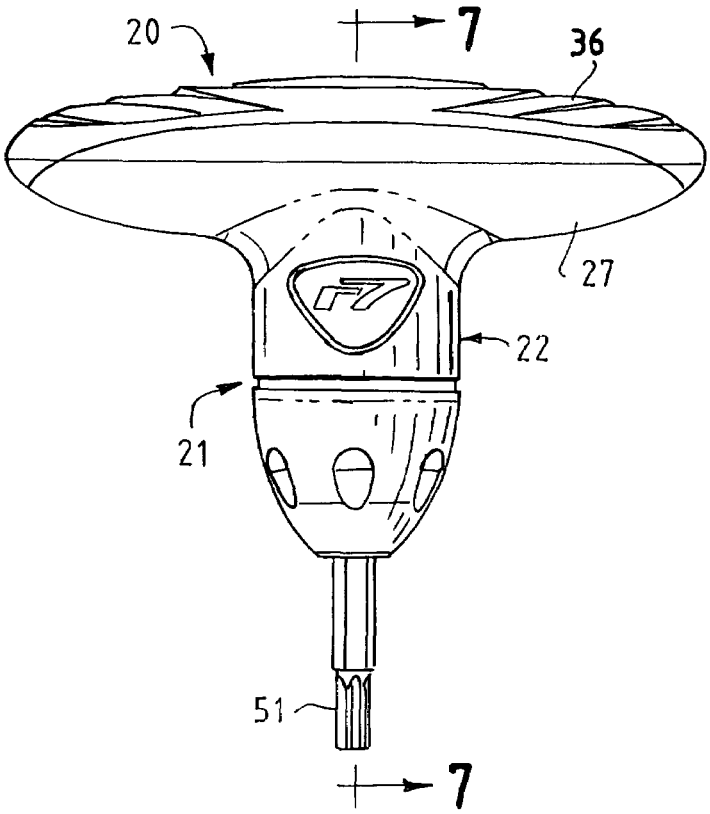
FIG. 1 is a front elevational view of a torque-limiting driver.
Figure 2:
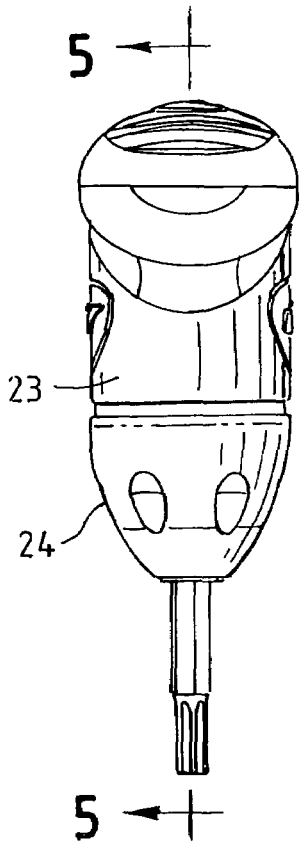
FIG. 2 is a right-hand side elevational view of the driver of FIG. 1.
Figure 4:
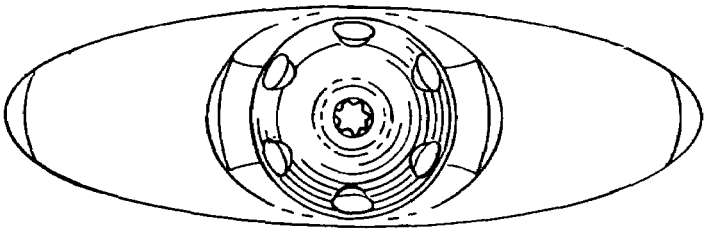
FIG. 4 is a bottom plan view of the driver of FIG. 1.
Figure 5:
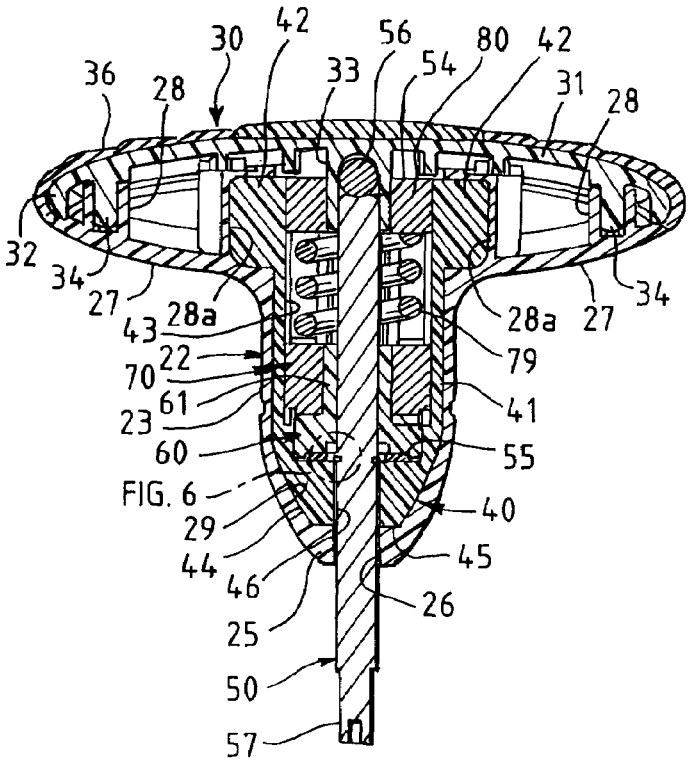
FIG. 5 is a sectional view taken generally along the line 5-5 in FIG. 2.
Figure 6:
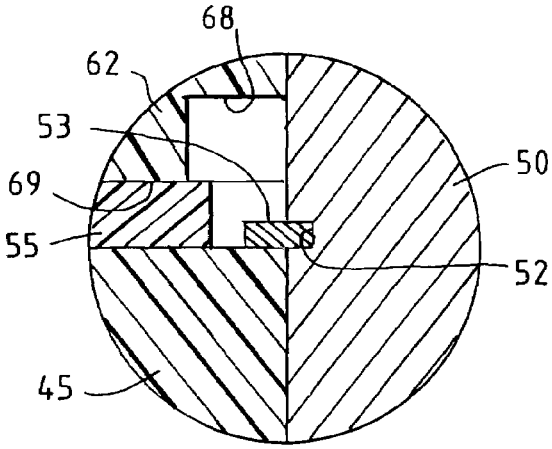
FIG. 6 is an enlarged, fragmentary sectional view of a portion of FIG. 5.
Figure 8:
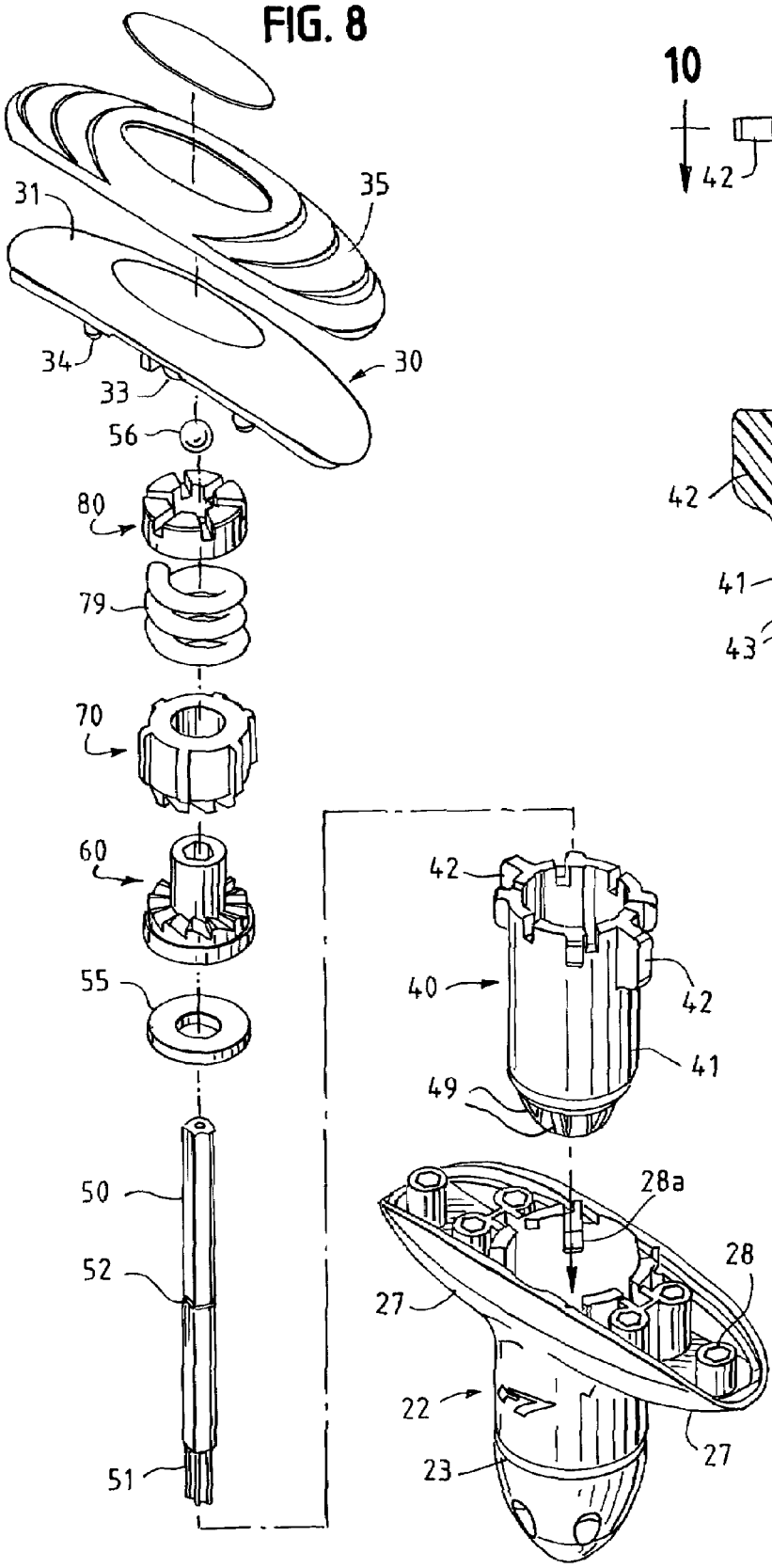
FIG. 8 is a reduced, exploded view of the driver of FIG. 1.
Figure 9:
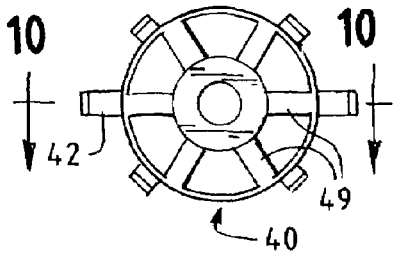
FIG. 9 is a reduced, bottom plan view of the sleeve of the driver of FIG. 5.
Figure 10:
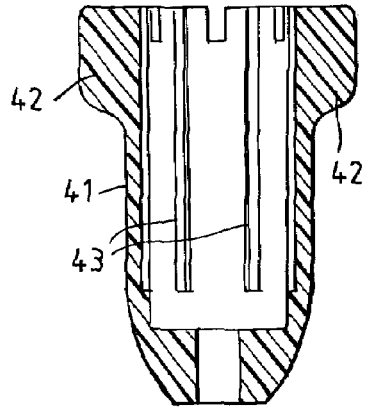
FIG. 10 is a sectional view taken generally along the line 10-10 in FIG. 9.

Referring in particular to FIGS. 5, 7 and 8, the driver 20 includes an elongated shaft 50, which may be hexagonal in transverse cross sectional shape and is provided at one end with a working tip 51, adapted for mateable engagement with an associated workpiece, such as a fastener or the like. The shaft 50 is provided intermediate its ends with a circumferential groove 52, in which is received a retaining ring 53 (FIG. 6). The shaft is provided at the end opposite the working tip 51 with a bearing end face 54. In assembly, the shaft 50 is received through the aligned bores 26 and 46 in the driver base member 22 and sleeve 40, with the retaining ring 53 seated on the inner surface of the sleeve end wall 45. A thrust washer 55 is also seated on the sleeve end wall 45 in surrounding relationship with the retaining ring 53. The end face 54 of the shaft 50 is adapted for engagement with a ball bearing 56 in a manner to be described more fully below.

Figure 11:
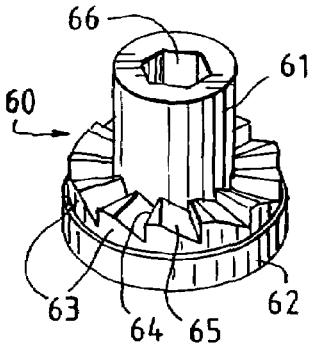
FIG. 11 is an enlarged, perspective view of the lower cam of the driver of FIG. 5.
Figure 12:
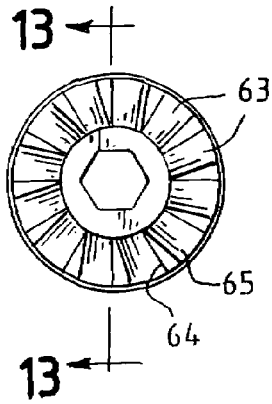
FIG. 12 is a top plan view of the cam of FIG. 11.
Figure 13:
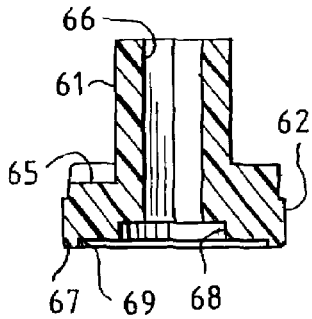
FIG. 13 is a sectional view taken generally along the line 13-13 in FIG. 12.

Referring also to FIGS. 11-13, the driver 20 includes a lower cam 60, which has an elongated, cylindrical shank 61 integral at one end with a radially outwardly extending annular flange 62, which is provided at its upper surface with a plurality of circumferentially spaced teeth 62. Each tooth 62 has an axial face 64 and a sloping face 65. A hexagonal bore 66 is formed axially through the lower cam 60 and is sized and dimensioned for mateably receiving the hexagonal shaft 50. The annular flange 62 has an end face 67 opposite the teeth 63, which has counterbores 68 and 69 formed therein coaxially with the bore 66 (see FIG. 13). In assembly, the lower cam 60 is fitted down over the shaft 50 with the end face 67 seated on the sleeve end wall 45 and with the thrust washer 55 received in the counterbore 69 and the retaining ring 53 received in the counterbore 68. The hexagonal bore 66 cooperates with the hexagonal shaft 50 to prevent rotation of the lower cam 60 relative to the shaft 50, the counterbore 68 having a depth sufficient to accommodate slight axial movement of the shaft 50 relative to the lower cam 60.

Figure 14:
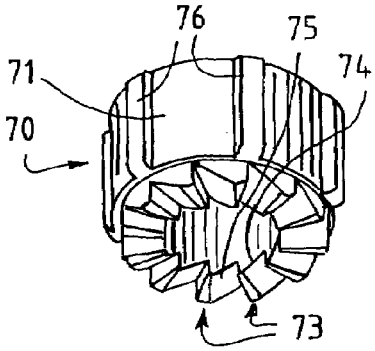
FIG. 14 is an enlarged, inverted, perspective view of the upper cam of the driver of FIG. 5.
Figure 15:
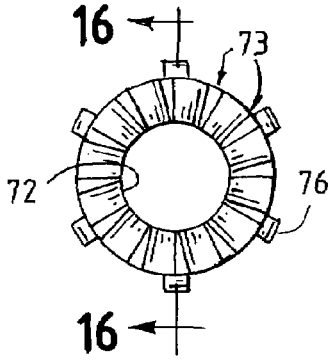
FIG. 15 is a top plan view of the upper cam of FIG. 14.
Figure 16:
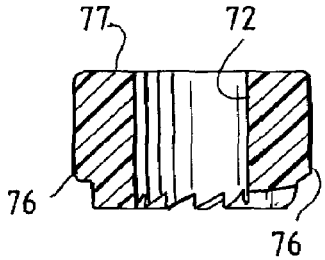
FIG. 16 is a sectional view taken generally along the line 16-16 in FIG. 15.

Referring now also to FIGS. 14-16, the driver 20 includes an upper cam 70, having an annular body 71 with a cylindrical bore 72 formed axially therethrough. Formed in the lower face of the annular body 71 is a plurality of circumferentially spaced teeth 73, each having an axial face 74 and a sloping face 75. Projecting radially outwardly from the outer surface of the annular body 71 at equiangularly spaced-apart locations are a plurality of axially extending keys 76, which may be six in number. The annular body 71 has an upper end face 77. In assembly, the upper cam 70 is fitted down coaxially over the upper end of the shaft 50, with the cylindrical shank 61 of the lower cam 60 received in the bore 72, with the teeth 73 mateably engaging the teeth 63 of the lower cam 60, and with the keys 76 respectively received in the keyways 43 of the sleeve 40, as can best be seen in FIGS. 5 and 7.

Thus, the keys 76 lock the upper cam 70 against rotation relative to the sleeve 40. The axial faces 74 of the teeth 73 respectively engage the axial faces 64 of the teeth 63 to prevent relative rotation of the upper and lower cams 70 and 60 in one direction, while the sloping teeth faces 75 and 65 engage to accommodate relative rotation of the upper and lower cams in the opposite direction. A helical compression spring 79 is fitted coaxially over the upper end of the shaft 50 within the sleeve 40 and is seated on the end face 77 of the upper cam 70.

Figure 17:
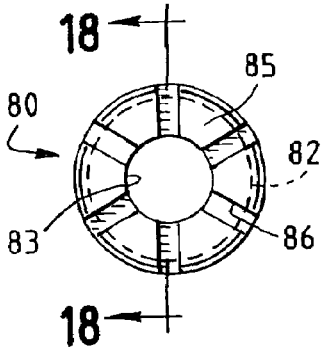
FIG. 17 is an enlarged top plan view of the adjustment plug of the driver of FIG. 5.
Figure 18:
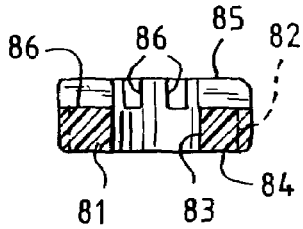
FIG. 18 is a sectional view taken generally along the line 18-18 in FIG. 17.

Referring now also to FIGS. 17 and 18, the driver 20 includes an annular adjustment plug 80 having an annular body 81 which is externally threaded, as at 82, adjacent to one end thereof, and is provided with a cylindrical axial bore 83 therethrough between a lower end face 84 and an upper end face 85. Formed in the upper end face 85 are a plurality of equiangularly spaced-apart radial slots 86, which may be six in number. In assembly, the adjustment plug 80 is fitted coaxially over the upper end of the shaft 50 and threadedly engaged in the upper end of the sleeve 40, for bearing against the upper end of the compression spring 79. In this regard, the slots 86 may accommodate a screwdriver or the like. The extent to which the plug 80 is threaded into the sleeve 40 controls the amount of compression or preload on the spring 79 which, in turn, controls the force with which the upper cam 70 is driven into engagement with the lower cam 60 and, thereby, the limiting torque required to effect relative rotation of the lower and upper cam 60 and 70, in a known manner.

To complete the assembly of the driver 20, the ball bearing 56 is seated in the cylindrical neck 33 of the cap 30, and the cap 30 is then fitted over the upper end of the base member 22, to a mounted position illustrated in FIGS. 5 and 7. In this position, the cylindrical neck 33 is fitted down within the bore 83 of the adjustment plug 80 in surrounding relationship with the upper end of the shaft 50, holding the ball bearing 56 against the end face 54 of the shaft 50, and the stakes 34 are respectively received in the sockets 28. The blades 35 on the cap 30 are respectively received in the radial slots 86 of the adjustment plug 80 for preventing it from loosening. The cap 30 may be snap-fitted to the base member 22, or may be fixed thereto as by sonic welding, solvent welding or the like. It will be appreciated that, in the latter case, the driver 20 is permanently assembled, with the shaft 50 non-removably mounted in place. Thus, the driver 20 will be usable with only a single type (shape and size) of mating fastener or the like. The parts may be economically constructed and the driver 20 may even be disposable, being designed for only limited use.

It will be appreciated that, in use, the arms 27 of the driver may be rested in the palm of the user's hand, with the fingers wrapped beneath the arms and straddling the stem portion 23. When the driver 20 is rotated in one direction, the shaft 50 will rotate with the housing 21 until a predetermined torque level is reached, at which point the biasing force exerted by the spring 79 is overcome to allow the sloping faces 75 of the upper cam 70 to slide up the sloping faces 65 of the lower cam 60 for the angular distance of one tooth, at which point the upper cam 70 will snap into engagement behind the next tooth of the lower cam 60, providing a tactile and/or audible indication to the user that the predetermined torque has been reached. When the driver 20 is rotated in the opposite direction, it will operate as a standard driver with no torque-limiting feature, since the engaging axial faces 64 and 74 of the cam teeth will prevent relative rotation of the lower and upper cams 60 and 70.

In a constructional model of the invention, the shaft 50, the retaining ring 53, the ball bearing 56 and the spring 79 may be formed of suitable metals, while the remaining parts may be formed of suitable plastics, which may be molded. From the foregoing, it can be seen that there has been provided an improved torque-limiting driver of simple and economical construction, which may be made disposable or for limited use and is provided with an ergonomical design.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A torque-limiting driver comprising:

a housing including a cap having a plurality of blades;

a shaft carried by the housing for rotation relative thereto and having a workpiece-engaging tip projecting from the housing;

torque-limiting means coupled between the housing and the shaft and responsive to rotation of the housing in a predetermined direction to rotate the shaft at torques below a predetermined torque and accommodating rotation of the housing relative to the shaft at said predetermined torque and above; and a torque-determining means having slots and disposed in the housing and movable relative to the torque-limiting means for adjusting the predetermined torque;

the blades being engageable in the slots for preventing torque-adjusting movement of the torque-determining means.

2. The torque-limiting driver according to claim 1, wherein the shaft is removably carried by the housing.

3. The torque-limiting driver according to claim 1, wherein the shaft is non-removably carried by the housing.

4. The torque-limiting driver according to claim 1, wherein the torque-limiting means includes a compression spring.

5. The torque-limiting driver according to claim 4, wherein the compression spring resiliently biases a first cam member into camming engagement with a second cam member.

6. The torque-limiting driver according to claim 5, wherein the torque-determining means is a plug and wherein the plug compresses the compression spring.

7. The torque-limiting driver according to claim 6, wherein the plug is movable to selectively vary the amount of compression on the compression spring.

8. The torque-limiting driver according to claim 7, wherein the amount of compression on the compression spring controls a predetermined force.

9. The torque-limiting driver according to claim 8, wherein the predetermined force prevents relative rotation of the first and second cam members until the predetermined torque is reached.

10. The torque-limiting driver according to claim 9, wherein the second cam member rotates relative to the first cam member once the predetermined torque is reached.

11. The torque-limiting driver according to claim 1, wherein the torque-determining means is rotatably movable.

12. The torque-limiting driver according to claim 1, wherein the torque-determining means is a plug fitted coaxially over an upper end of the shaft.

13. The torque-limiting driver according to claim 12, wherein the plug is threaded and is received by a sleeve internal to the housing.

* * * * *